US006881308B2

(12) United States Patent
Denvir et al.

(10) Patent No.: US 6,881,308 B2
(45) Date of Patent: Apr. 19, 2005

(54) ELECTROCHEMICAL SYNTHESIS OF AMMONIA

(75) Inventors: Adrian J. Denvir, Bryan, TX (US); Oliver J. Murphy, Bryan, TX (US); Alan J. Cisar, Cypress, TX (US); Priscilla Robertson, Bryan, TX (US); Kyle Uselton, College Station, TX (US)

(73) Assignee: Lynntech, Inc., College Station, TX (US)

( * ) Notice: Subject to any disclaimer, the term of this patent is extended or adjusted under 35 U.S.C. 154(b) by 178 days.

(21) Appl. No.: 10/090,444

(22) Filed: Mar. 4, 2002

(65) Prior Publication Data

US 2003/0164292 A1 Sep. 4, 2003

Related U.S. Application Data

(63) Continuation of application No. 10/090,443, filed on Mar. 4, 2002.

(51) Int. Cl.[7] ..... C25B 9/06; C25B 9/18; C25B 3/02

(52) U.S. Cl. ..... 204/243.1; 204/252; 204/244; 204/246; 204/284

(58) Field of Search ..... 204/252, 243.1, 204/244, 246, 284, 267, 270, 291

(56) References Cited

U.S. PATENT DOCUMENTS 2,716,670 A * 8/1955 Bacon ..... 429/34
3,393,098 A * 7/1968 Hartner et al. ..... 429/13
3,647,415 A * 3/1972 Yano et al. ..... 428/402
3,753,782 A * 8/1973 Beccu et al. ..... 429/221
5,071,516 A * 12/1991 Furuya ..... 205/477
5,584,981 A * 12/1996 Turner et al. ..... 204/536

FOREIGN PATENT DOCUMENTS

JP 02-054790 A * 2/1990 ..... C25B/1/00
JP 02054790 A * 2/1990 ..... C25B/1/00

OTHER PUBLICATIONS

Marnellos et al., "Ammonia Synthesis at Atmospheric Pressure", Science, vol. 282, Oct. 2, 1998, pp. 98–100.*
"Assessment of Research Needs for Advanced Fuel Cells"; S.S. Penner; Energy, The International Journal; vol. 11, No. ½.
"Ammonia Synthesis at Atmospheric Pressure"; George Marnellos and Michael Stoukides, SCIENCE, vol. 282, Oct. 2, 1998.

(Continued)

*Primary Examiner*—Roy King
*Assistant Examiner*—Harry D. Wilkins, III
(74) *Attorney, Agent, or Firm*—Streets & Steele; Jeffrey L. Streets; Frank J. Campigotto

(57) ABSTRACT

A method for electrochemical synthesis of ammonia gas comprising providing an electrolyte between an anode and a cathode, providing hydrogen gas to the anode, oxidizing negatively charged nitrogen-containing species present in the electrolyte at the anode to form an adsorbed nitrogen species, and reacting the hydrogen with the adsorbed nitrogen species to form ammonia. Preferably, the hydrogen gas is provided to the anode by passing the hydrogen gas through a porous anode substrate. It is also preferred to produce the negatively charged nitrogen-containing species in the electrolyte by reducing nitrogen gas at the cathode. However, the negatively charged nitrogen-containing species may also be provided by supplying a nitrogen-containing salt, such as lithium nitride, into the molten salt electrolyte mixture in a sufficient amount to provide some or all of the nitrogen consumed in the production of ammonia.

47 Claims, 4 Drawing Sheets

OTHER PUBLICATIONS

"Electrochemical Reduction of Nitrogen Gas in a Molten Chloride System"; Takuya Goto and Yasuhido Ito, *Electrochimica Acta.*, vol. 43, Nos. 21–22; pp. 3379–3384, 1998.
"Electrochemical Behavior of Nitride Ions in a Molten Chloride System"; Takuka Goto, Masayuki Tada, and Yasuhiko Ito, Electrochemical Society, vol. 144, No. 7, Jul. 1997, pp. 2271–2275.
"Acceleration of Electrochemical Titanium Nitride Growth by Addition of LiH in a Molten LiCl–KCl–$Li_3N$ System", T.Nishiklor, T. Nohira, T. Goto, and Y. Ito, Electrochemical and Solid–State Letters, 2 (6) 278–280 (1999).
"Molten Salts—a survey of recent developments", J H R Clarke and G J Hills, Reprinted from chemistry in Britain, vol. 9, No. 1, Jan. 1973, Current awareness.
"Surface Electrochemistry of the Anodic $N_2$ Generation Reaction at Pt and Au, and the Discovery of Cathodic $N_2$ Evolution", S. G. Roscoe and B. E. Conway, J. Electroanal Chem. 249 (1988) 217–239.

* cited by examiner

ELECTROCHEMICAL SYNTHESIS OF AMMONIA

This application is a continuation of pending U.S. patent application Ser. No. 10/090,443, filed on Mar. 4, 2002.

This invention was made with government support under grants nos. 00-33610-8929 and 2002-3310-12426 awarded by the U.S. Department of Agriculture (USDA). The Government has certain rights in this invention.

BACKGROUND OF THE INVENTION

1. Field of the Invention

This present invention relates to an electrochemical method and apparatus for the synthesis of ammonia.

2. Background to the Related Art

Ammonia ($NH_3$) is a colorless alkaline gas that is lighter than air and possesses a unique, penetrating odor. Since nitrogen is an essential element to plant growth, the value of nitrogen compounds as an ingredient of mineral fertilizers, was recognized as early as 1840. Until the early 1900's, the nitrogen source in farm soils was entirely derived from natural sources. Haber and Bosch pioneered the synthesis of ammonia directly from hydrogen and nitrogen on a commercial scale in 1913. Further developments in large-scale ammonia production for fertilizers have made a significant impact on increasing the world's food supply.

Virtually every nitrogen atom of a nitrogen compound travels from the atmosphere to its destined chemical combination by way of ammonia. Industrial uses of ammonia as a nitrogen source has recently consumed a greater share of the total ammonia production, accounting for 20% of the world output. Up to 80% of the ammonia produced is used for the production of nitrogen-based fertilizers, accounting for about 3% of the world's energy consumption. In many developing countries, the capability for ammonia synthesis is the first sign of budding industrialization. In the United States last year there was over 19 billion tons of ammonia produced.

Many methods of ammonia synthesis have been investigated. These methods include the catalytic synthesis of ammonia from its elements using large-scale pressures and temperatures, indirect ammonia synthesis using the steam decomposition of nitrogen based compounds, and the formation of ammonia with the aid of electrical discharge. Only recently has the possibility of using electrochemistry for ammonia synthesis been demonstrated. The electrochemical process is operated at atmospheric pressure and 570° C., which is a similar temperature to that used in the Haber-Bosch process. The apparatus consists of a non-porous, strontia-ceria-ytterbia (SCY) perovskite ceramic tube closed at one end and then further enclosed in a ceramic tube. Electrodes, made from polycrystalline palladium films, are deposited on the inner and outer walls of the SCY tube.

Ammonia gas is passed through the system, where the amount of decomposition due to heating can be measured. Subsequently, gaseous hydrogen is passed through the quartz tube and over the anode surface, where the hydrogen is converted to protons:

$$3H_2 \rightarrow 6H^+ + 6e^- \quad (1)$$

The protons then diffuse through the solid perovskite electrolyte to the cathode surface, where they come in contact with the nitrogen gas and the following reaction takes place:

$$N_2 + 6H^+ + 6e^- \rightarrow 2NH_3 \quad (2)$$

However, the efficiency of the reaction is reduced by the high temperatures needed for the reaction to occur.

Therefore, there remains a need for an improved method of producing ammonia. It would be desirable if the improved method could produce ammonia at lower temperatures and lower pressures, while achieving a greater conversion than existing methods. It would be even further desirable if the improved method were compatible with existing process units, such as being able to use the same hydrogen and nitrogen sources as are used in the Haber-Bosch process.

SUMMARY OF THE INVENTION

The present invention provides a method for synthesizing ammonia gas, comprising the steps of providing an electrolyte between an anode and a cathode, providing hydrogen gas to the anode, oxidizing negatively charged nitrogen-containing species present in the electrolyte at the anode to form adsorbed nitrogen species, and reacting the hydrogen with the adsorbed nitrogen species to form ammonia. The negatively charged nitrogen-containing species is preferably a nitride ion, such as lithium nitride, or an azide ion, such as sodium azide.

The reaction is preferably carried out at a temperature between 0 and 1000 Celsius, such as a temperature between 25 and 800 Celsius or between 100 and 700 Celsius, or more preferably between 300 and 600 Celsius, although a lower temperature of between 25 and 150 Celsius may be desirable. The method includes applying a voltage between the anode and the cathode, where the voltage is preferably up to 2 Volts, up to 1 Volt, or up to 0.5 Volt. It is also preferred to apply a current density between the anode and the cathode of up to 2 $A/cm^2$, up to 1 $A/cm^2$, or up to 0.5 $A/cm^2$. Furthermore, the reaction is typically carried out at a pressure between 1 and 250 atmospheres, preferably between 1 and 100 atmospheres, more preferably between 1 and 50 atmospheres, even more preferably between 1 and 20 atmospheres, and most preferably up to 5 atmospheres, including atmospheric pressure.

The hydrogen gas preferably has a purity of greater than 70 percent, more preferably greater than 70 percent. The hydrogen gas is preferably provided to the anode by passing the hydrogen gas through a porous anode substrate. Preferably, the hydrogen gas passes from a first face of the porous anode substrate to a parallel opposite face of the porous anode substrate, wherein the parallel opposite face is in contact with the electrolyte.

The porous anode substrate preferably has porosity greater than 40 percent, but may have porosity greater than 90 percent. Optionally, the porous anode substrate has a thin nonporous, hydrogen-permeable metal film or membrane facing the electrolyte to produce adsorbed atomic hydrogen from hydrogen gas passing there through. The metal membrane can be made from a metal selected from palladium, a palladium alloy, iron, tantalum, and combinations thereof. In addition, it is optional to provide a catalyst disposed on a surface of the metal membrane facing the electrolyte, preferably wherein the catalyst is disposed on at least part of the second surface of the porous anode substrate facing the electrolyte. The metal membrane can also be supported by a matrix formed from a material selected from nickel and nickel-containing alloys. Alternatively, the matrix can be formed from electrically conducting inorganic ceramic materials or a material selected from transition metals and transition metal-containing alloys. Preferably, the metal membrane is a composite comprising a non-noble metal, such as iron, tantalum and the lanthanide metals, having palladium or a palladium-containing alloy on each side of the non-noble metal. In operation, the hydrogen gas may be delivered to the metal membrane from a process selected from steam reformation, partial oxidation, autothermal reformation, and plasma reformation. Alternatively, hydrogen gas may be provided to the porous anode substrate by electrolyzing water. In any of these embodiments, the hydrogen gas may be delivered to the porous anode substrate along with a carrier gas.

It is preferred to produce the negatively charged nitrogen-containing species in the electrolyte by reducing nitrogen gas at the cathode. The nitrogen gas may be delivered through a porous cathode substrate. The porous cathode substrate is preferably made from a metal, metal alloy, ceramic or a combination thereof, most preferably made from nickel, a nickel-containing compound, or a nickel alloy. Alternatively, the porous cathode substrate may be selected from metal carbides, metal borides and metal nitrides. A preferred porous cathode substrate has a pore size of about 0.2 microns. The porous cathode substrate may be coated with a porous electrocatalyst, for example an electrocatalyst selected from transition metals, noble metals, and combinations thereof. The nitrogen gas preferably contains less than 1000 ppm moisture, more preferably less than 100 ppm moisture, and most preferably less than 10 ppm moisture. The moisture may be controlled or reduced by passing the nitrogen gas through a water sorbent material before delivery to the porous cathode. The nitrogen gas should also contain less than 0.1 percent oxygen. Preferably the process includes both providing the hydrogen to the anode catalyst, and reducing nitrogen gas at the cathode to produce negatively charged nitrogen-containing species in the electrolyte, wherein the hydrogen gas and the nitrogen gas are provided at gas pressures greater than the pressure of the reaction.

The electrolyte preferably comprises a molten salt electrolyte that supports migration of the negatively charged nitrogen-containing species between the cathode and the anode. A preferred molten salt electrolyte comprises lithium chloride and potassium chloride, most preferably wherein the molten salt has a greater molar concentration of lithium chloride than potassium chloride. An equally preferred molten salt is selected from the alkali metal tetrachloroaluminates. Preferably, the molten salt electrolyte is charged with a nitride compound, an azide compound, or a combination thereof. The preferred nitride compounds are the nitride salts, such a lithium nitride. Furthermore, the molten salt may further comprise one or more metal salts selected from chlorides, iodides, bromides, sulfides, phosphates, carbonates, and mixtures thereof. Where the metal salt is a metal chloride, the metal chloride may comprise rubidium chloride, cesium chloride, ruthenium chloride, iron chloride, or a mixture thereof. The electrolyte may optionally comprise a salt dissolved in an organic solvent. The method should include maintaining an inert atmosphere over the electrolyte.

The present invention also provides an apparatus comprising a porous anode substrate in fluid communication with a source of hydrogen gas, a porous cathode substrate in fluid communication with a source of nitrogen gas, and an electrolyte disposed within a matrix, wherein the matrix is disposed between the porous anode substrate and the porous cathode substrate. Optionally, a catalyst may be disposed on the porous anode substrate and/or the porous cathode substrate facing the electrolyte matrix. Alternatively, a metal membrane may be disposed on the porous anode substrate facing the electrolyte matrix, preferably including an ammonia generating catalyst disposed on a surface of the metal membrane facing the electrolyte. The preferred catalysts capable of generating ammonia comprise a metal selected from iron, ruthenium and combinations thereof. In particular, the catalyst may be a ruthenium catalyst that is activated by cesium and barium and is supported on a graphite bed, or a barium-activated ruthenium on a magnesium oxide support.

Furthermore, the present invention provides an apparatus comprising a plurality of electrolytic cells and a bipolar plate separating each of the plurality of electrolytic cells. Accordingly, each of the plurality of electrolytic cells comprises a porous anode substrate in fluid communication with a source of hydrogen gas, a porous cathode substrate in fluid communication with a source of nitrogen gas, an electrolyte disposed within a matrix placed between the porous anode substrate and the porous cathode substrate, an anodic fluid flow field in electronic communication with the porous anode substrate opposite the matrix, and a cathodic fluid flow field in electronic communication with the porous cathode substrate opposite the matrix. Preferably, the anodic fluid flow field has a first face that is in electronic communication with the porous anode substrate and a second face in electronic communication with a first bipolar plate, and the cathodic fluid flow field has a first face that is in electronic communication with the porous cathode substrate and a second face in electronic communication with a second bipolar plate. The apparatus will typically further comprise hydrogen gas inlet and outlet manifolds for providing the fluid communication between the source of hydrogen gas and each of the porous anode substrates, and nitrogen gas inlet and outlet manifolds for providing the fluid communication between the source of nitrogen gas and each of the porous cathode substrates. The hydrogen gas manifolds and the nitrogen gas manifolds are each selected from either an internal manifold or an external manifold. In a preferred embodiment, anodic cell frames and cathodic cell frames are disposed around the anode flowfields and cathode flowfields, respectively. These cell frames must be able to withstand the high temperatures, high pressures and harsh chemical environment of the molten salts. Accordingly, the cell frames may be made, for example, from graphite for process temperatures up to 500 Celsius, Inconel or Monel.

In one embodiment, the porous anode substrate and the porous cathode substrate are each selected from metal foams, metal grids, sintered metal particles, sintered metal fibers, and combinations thereof. Preferably, two or more of the metal components of the cell are metallurgically bonded together, such as by a process selected from welding, brazing, soldering, sintering, fusion bonding, vacuum bonding, and combinations thereof. For example, the anodic fluid flow field may be metallurgically bonded to the bipolar plate, the cathodic fluid flow field may be metallurgically bonded to the bipolar plate, the anodic fluid flow field may be metallurgically bonded to the porous anode substrate, the cathodic fluid flow field may be metallurgically bonded to the porous cathode substrate, and combinations thereof.

BRIEF DESCRIPTION OF THE DRAWINGS

So that the above recited features and advantages of the present invention can be understood in detail, a more particular description of the invention, briefly summarized above, is provided in reference to the embodiments thereof, which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention provides a method for electrochemical synthesis of ammonia gas. The method comprises providing an electrolyte between an anode and a cathode, providing hydrogen gas to the anode, oxidizing negatively charged nitrogen-containing species present in the electrolyte at the anode to form an adsorbed nitrogen species, and reacting the hydrogen with the adsorbed nitrogen species to form ammonia. Preferably, the hydrogen gas is provided to the anode by passing the hydrogen gas through a porous anode substrate. It is also preferred to produce the negatively charged nitrogen-containing species in the electrolyte by reducing nitrogen gas at the cathode. However, the negatively charged nitrogen-containing species may also be provided by supplying a nitrogen-containing salt, such as lithium nitride, into the molten salt electrolyte mixture in a sufficient amount to provide some or all of the nitrogen consumed in the production of ammonia.

Figure 1:
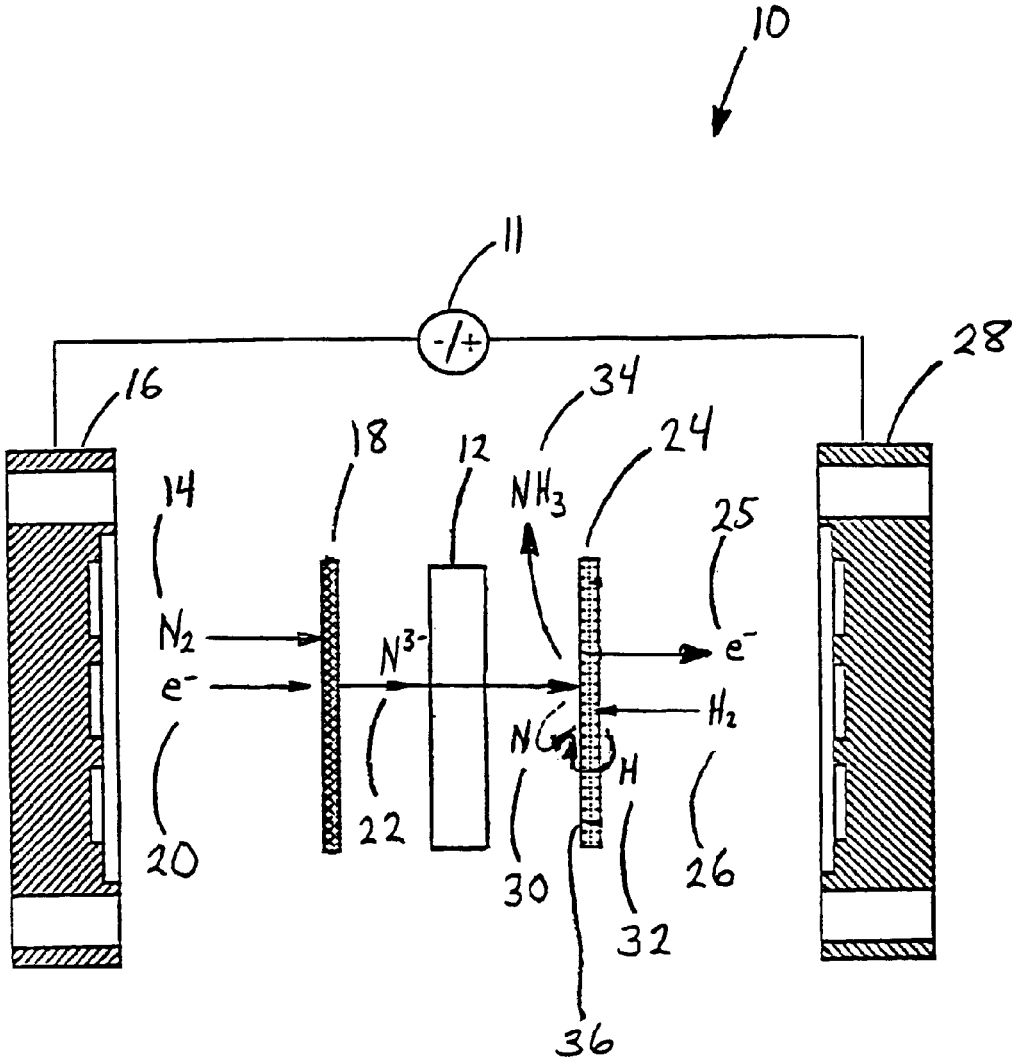
FIG. 1 is a schematic flow diagram of an ammonia synthesis cell of the present invention.

FIG. 1 is a schematic flow diagram of an ammonia synthesis cell of the present invention. The electrochemical cell or reactor 10 is provided with a molten salt electrolyte 12. The cell is heated to keep the electrolyte in a molten state and may be pressurized. Nitrogen gas ($N_2$) 14 is introduced into the cell 10 from an endplate 16 and through a porous cathode 18. The molecular nitrogen gas 14 is reduced by electrons 20 to give two nitride ions ($N^{3-}$) 22 at the cathode 18 in a six-electron reduction process. The nitride ions 22, which are stable in the molten salt electrolyte, migrate through the electrolyte 12 towards the anode 24.

The cathode is a porous, electronically conducting member where nitrogen or nitrogen containing compounds are reduced to a negatively charged nitrogen species. The cathode may be made from a metal, metal alloy or ceramic material. Preferably, the cathode is made from porous nickel or a nickel-containing compound, such as a nickel alloy (Inconel, Monel, Stainless steel and their families of alloys).

The anode is a porous, electronically conducting member 24 allowing the introduction of hydrogen gas 26 from endplate 28. At the anode, the hydrogen 26 diffuses through the anode to the surface 36 in contact with the molten salt 12 where the hydrogen is adsorbed, perhaps in the form of adsorbed atomic hydrogen 32. The nitride ions 22 reach the porous anode 24 where the electron transfer reaction occurs and the nitride ion is oxidized to adsorbed atomic nitrogen (N) 30 by giving up electrons 25. The oxidation potential for the nitride ion to atomic nitrogen occurs at a more negative potential than hydrogen oxidation and thus it will occur in preference to the hydrogen reaction. The atomic nitrogen 30 adsorbed on the anode surface 36 then reacts with neighboring hydrogen atoms 32 to produce ammonia gas 34 that is evolved and collected. Preferably, the porous anode substrate 24 includes a catalyst-coating, such as iron, ruthenium, or a mixture thereof disposed on the surface 36 facing the electrolyte.

The kinetics of the ammonia production reaction can be controlled by regulating the electrode potentials. For example, by controlling the anode and cathode potentials, the current efficiency for the conversion of nitrogen gas to nitride ion in a molten salt electrolyte with a nickel cathode is greater than 93%. The conversion of nitrogen and hydrogen to ammonia is an exothermic reaction and hence the conversion increases with decreasing temperature. The present method for electrochemical ammonia generation will operate at considerably lower temperatures than those used in the Haber-Bosch process, thereby benefiting the equilibrium process represented by equation (3). It is believed that by combining potentiometric control, low operating temperatures, and pressure regulation, the present method will produce ammonia in higher yields than that produced by current methods.

$$0.5N_2+1.5H_2 \leftrightarrows NH_3 H_{298}=-45.72 \text{ kJ/mol} \quad (3)$$

Nitrogen gas is the preferred source of the negatively charged nitrogen containing species. Preferably, the nitrogen gas used for the electrolysis is high purity and contains less than 2 ppm moisture. This can be achieved by using a high-purity nitrogen source that passes though a water sorbent material before it enters the reactor. The nitrogen may be supplied from the same nitrogen source currently used in ammonia manufacturing. Alternatively, the nitrogen gas can be provided by a liquid nitrogen source, air, or the decomposition of nitrogen containing compounds. Nitrogen can also be introduced to the cell in combination with a carrier gas such as argon, or other inert gaseous materials, carbon dioxide or other gaseous species or a combination thereof. Preferably, the nitrogen is introduced to the system via a series of flow fields or flow field/gas diffusion electrode arrangements. The flow of the nitrogen can be controlled via series of pumps, valves, pressurized vessels, suction devices or a combination thereof.

The hydrogen may be obtained from the same sources as it is presently obtained for use in conventional processes for ammonia production, including coke oven gas and coal, natural gas, naptha, and other petroleum products converted via steam reformation or partial oxidation. Alternatively, the hydrogen can be supplied by the electrolysis of water or the decomposition of other hydrogen containing compounds including metal hydrides. The hydrogen can also be introduced to the cell along with a carrier gas, such as argon or other inert gaseous materials, carbon dioxide or other gaseous species, or a combination thereof. Preferably, the hydrogen gas is introduced to the system via a series of flow fields or flow field/gas diffusion electrode arrangements. The flow of the hydrogen can be controlled via a series of pumps, valves, pressurized vessels, suction devices or a combination thereof.

The electrolyte must be capable of forming, stabilizing and permitting migration of the negatively charged nitrogen-containing species between the cathode and anode. Also, the electrolyte must be chemically and electrochemically stable and inert under the conditions required for the electrochemical synthesis of ammonia. The anion of the molten salt must not undergo an electrochemical oxidation process at the anode and the cation of the molten salt must not undergo an electrochemical reduction process at the cathode. The preferred electrolyte comprises one or more molten salts selected from metal chlorides, iodides, bromides, carbonates, sulfides, phosphates, and mixtures thereof. It is also preferred to add other salts, such as rubidium chloride, cesium chloride, ruthenium chloride, iron chloride, or a mixture thereof, in small portions, such as 0.1 to 5 percent, to lower the melting temperature of the eutectic. One particularly preferred molten salt mixture includes 59% LiCl/

41% KCl/0.1% $Li_3N$. However, in addition to the foregoing electrolytes, it is believed that the present invention will also operate using low temperature molten salts, described in more detail below.

The electrolyte will preferably contain an electroactive species, such as nitride ions or azide ions, that are present not as a result of a reduction or oxidation reaction of a nitrogen containing species at the electrodes, but are present as species that have been added to the electrolyte. For example, it is preferred to provide the electrolyte with small quantities of $Li_3N$ to allow the ammonia production reaction to start. Finally, it is preferred to charge the electrochemical cell with the mixed, dried electrolyte salts and heat them into a molten state, but it is also possible to melt the electrolyte before charging the electrolyte into the cell. Prior to melting, the salts should be dried and mixed together in an inert atmosphere, preferably with less than 2 ppm moisture.

The reaction is preferably carried out at a temperature between 0 and 1000 Celsius, such as a temperature between 25 and 800 Celsius or between 100 and 700 Celsius, or more preferably between 300 and 600 Celsius, although a lower temperature of between 25 and 150 Celsius may be desirable from an energy consumption standpoint.

Furthermore, the reaction is typically carried out at a pressure between 1 and 250 atmospheres, preferably between 1 and 100 atmospheres, more preferably between 1 and 50 atmospheres, even more preferably between 1 and 20 atmospheres, and most preferably up to 5 atmospheres, including atmospheric pressure. The cell can be pressurized using the reactant gases, but the internal pressure of the cell must be prevented from exceeding the reactant gas pressure within the anode or cathode in order to prevent backflow of molten salts into the porous electrodes or failure of the electrodes or metal membranes within the cell.

Once the cell has been assembled, charged with electrolyte, and heated to the operational temperature and pressure, then a voltage is applied between the anode and cathode. The preferred voltage is up to 2 Volts, up to 1 Volt, or up to 0.5 Volts. It is also preferred to apply a current density between the anode and the cathode of up to 2 $A/cm^2$, up to 1 $A/cm^2$, or up to 0.5 $A/cm^2$. In the preferred embodiment, nitrogen gas is introduced at the cathode and hydrogen gas is introduced at the anode. While the voltage may be regulated using a reference electrode, such as a lithium/lithium ion reference electrode as used in the examples below, it should be apparent that the no reference electrode is required.

Figure 2:
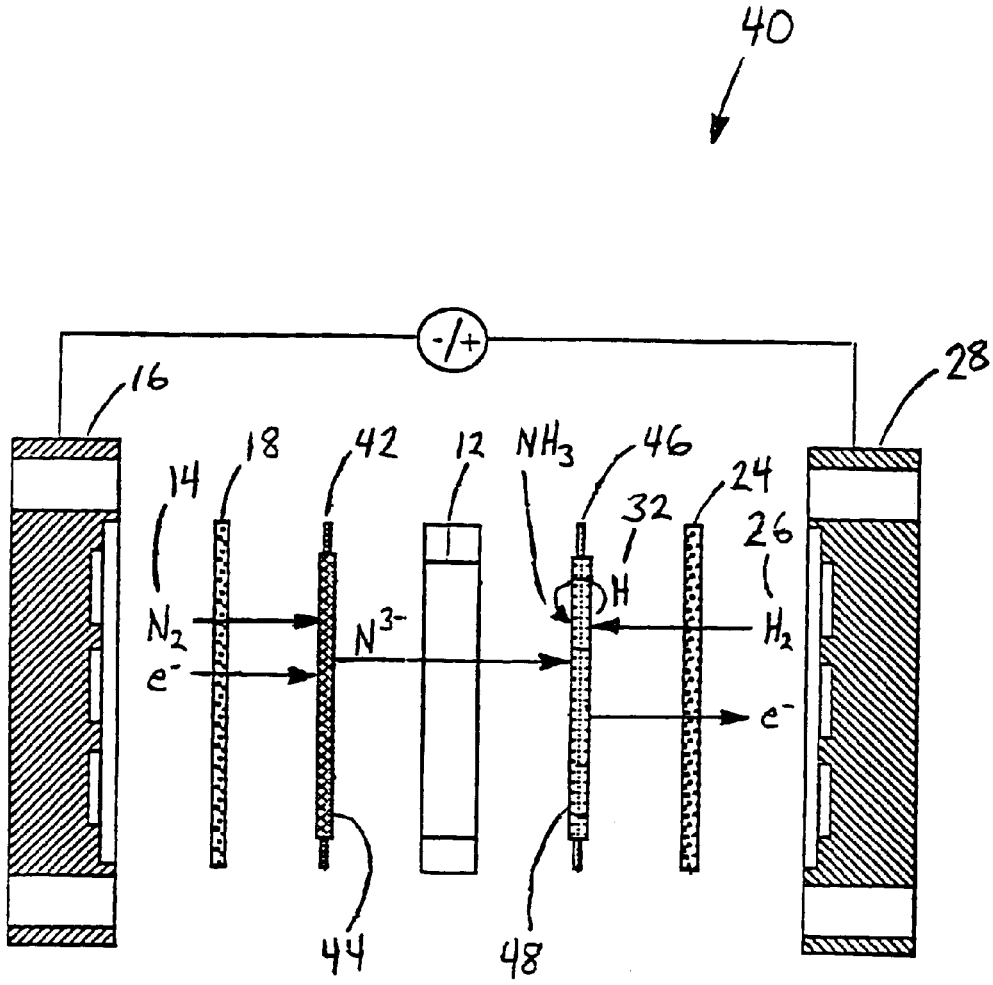
FIG. 2 is a schematic flow diagram of a second ammonia synthesis cell of the present invention.

FIG. 2 is a schematic flow diagram of a second ammonia synthesis cell of the present invention. The cell 40 operates in almost identical fashion to cell 10 of FIG. 1, except that it includes a gas diffusion electrode 42 in combination with the porous cathode 18 and a metal membrane 46 in combination with the porous anode 24.

The metal membrane 46 separates hydrogen gas from other gaseous components or contaminants and splits the molecular hydrogen 26 into atomic hydrogen 32. The atomic hydrogen 32 diffuses through the membrane 46 to the outer surface 48 where the atomic hydrogen is adsorbed. The membrane structure is preferably supported on a matrix that imparts greater mechanical strength to the metal membrane. Most preferably, the support matrix is provided by the porous anode 24 and includes the necessary flow field or flow field/gas diffusion electrode arrangements to allow hydrogen to be distributed evenly across the face of the anode.

The support matrix can be made from a nickel-containing compound such as a nickel alloy (Inconel, Monel, Stainless steel and their families of alloys), transition metals and their corresponding families of alloys, or combinations thereof. Conducting inorganic materials including ceramics in combination with the metal species mentioned above can also be used. The metal membrane may also be used as an anode without the use of a support matrix.

Preferably, the metal membrane is made from palladium alloys, where the palladium concentration varies from 100 wt % to 5 wt % and the alloying metal is a transition metal, main group metal (sp), or a combination thereof. The most preferred metal membrane is made from a palladium silver alloy 75:25 wt % Pd:Ag. Furthermore, body-centered cubic refractory metals, such as zirconium, niobium, tantalum, and vanadium, having significantly higher bulk hydrogen permeability than palladium, can be used as a direct replacement for palladium.

Figure 3:
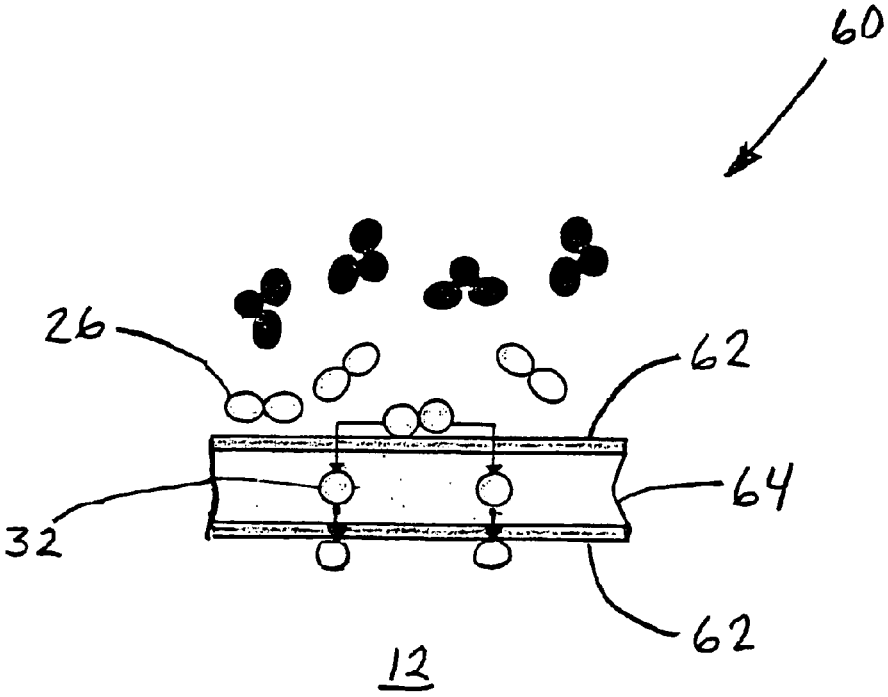
FIG. 3 is a schematic diagram of a composite metal membrane for hydrogen diffusion.

FIG. 3 is a schematic diagram of a composite metal membrane for hydrogen diffusion. The composite structure 60 includes a palladium-containing layer 62 deposited on both sides of a refractory metal 64. This construction allows the dissociation of the molecular hydrogen 26 into atomic hydrogen 32 upon passing through the palladium surface layer 62, followed by rapid transport of the atomic hydrogen 32 through the refractory metal 64, so that the atomic hydrogen is adsorbed on the opposite palladium surface facing the electrolyte 12. The refractory metal is chosen for its ability to transport hydrogen and to offer structural integrity for the composite membrane. Such a structure has several advantages. First, greater overall atomic hydrogen fluxes are possible because the diffusion is not limited by the face centered cubic (f.c.c) structure of the palladium. Because of this, the membrane can be thicker, providing improved mechanical or structural properties while still providing acceptable, and even improved, hydrogen fluxes. Second, since the refractory metals are significantly less expensive than palladium, these membranes are more economical because only two thin layers of palladium are needed. Further, while the Group V metals are subject to hydrogen embrittlement, this regime is only a problem well below room temperature. Should the palladium layer develop defects, such as those caused by the palladium phase transformation, the membrane would still be functional because the defect would expose only a minute area of the refractory metal.

Optionally, the metal membrane system will incorporate an ammonia generating catalyst to act as the electrode on the outer surface 48 of the membrane 46 facing the electrolyte 12 (See FIG. 2). The hydrogen atoms diffuse through the metal membrane layer onto the ammonia catalyst surface where they react with the adsorbed nitrogen atoms.

The metal membrane may have any reasonable thickness, but it does not need to be any thicker than 1 to 200 $\mu$m. However, the thickness of the membrane can be increased to improve the mechanical strength or decreased to provide for more increased hydrogen transport. For example, a particularly preferred composite metal membrane may be prepared from a tantalum foil. The tantalum foil is placed into a vacuum chamber that is pumped down to $10^{-6}$ torr. An argon gun may then be used to remove the native surface oxides, followed by a sputtering of palladium onto the tantalum surface.

The present invention also provides an apparatus for generating ammonia gas. The apparatus comprises a porous anode substrate in fluid communication with a source of hydrogen gas, a porous cathode substrate in fluid communication with a source of nitrogen gas, and an electrolyte disposed between the porous anode substrate and the porous cathode, where the electrolyte is preferably a molten salt disposed within a matrix. The anode substrate and/or the cathode substrate may have a catalyst disposed on the surface of the substrate facing the electrolyte. The apparatus may include a stack of electrochemical cells, including a bipolar separator plate disposed between each of the cells in the stack. The apparatus is compatible with either internal manifolding or external manifolding for the supply of the hydrogen and nitrogen gases, as well as the removal of the ammonia gas produced. In a particularly preferred embodiment, two or more adjacent cell components are metallurgically bonded to form an integrated subassembly in order to reduce the electrical resistance of the cell and reduce the number of separate components that must be assembled.

Figure 4:
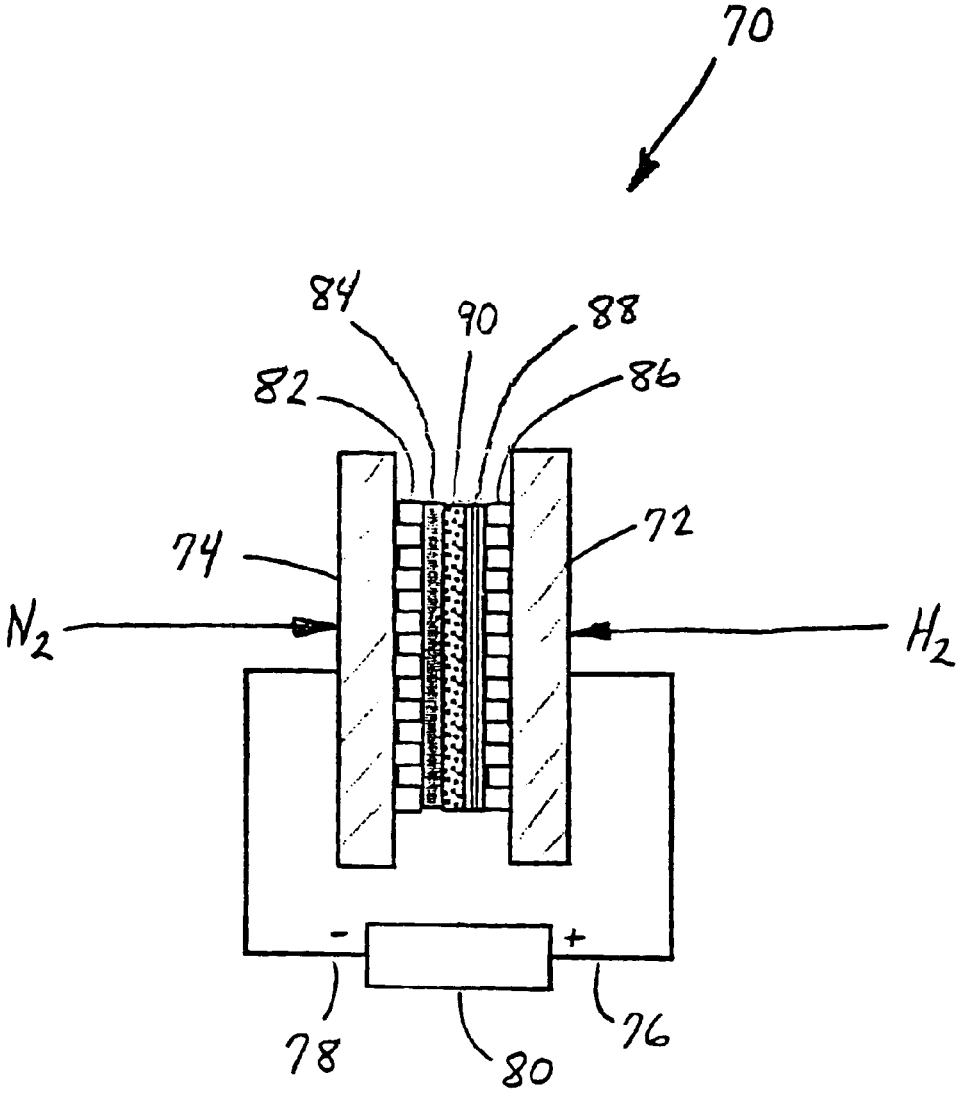
FIG. 4 is a schematic structural diagram of an ammonia synthesis cell stack.

FIG. 4 is a schematic structural diagram of an ammonia synthesis cell or reactor 70 similar to a molten carbonate fuel cell. The reactor 70 includes an anode endplate 72 and cathode endplate 74 that secure the cell components together and are coupled to the positive terminal 76 and negative terminal 78 of a power supply 80, respectively. An anode flow field 86 is provided to distribute hydrogen gas over the porous anode 88. Similarly, a cathode flow field 82 is provided to distribute nitrogen gas over the porous cathode 84. An electrolyte 90 is disposed between the porous anode and the porous cathode. Many important factors, such as materials compatibility, electrolyte loss, and operating conditions have been well developed for working in the aggressive environment associated with molten salts. Also, the design of the electrochemical cell allows for minimum ohmic losses in the system that leads to a reduction of power consumption.

The electrolyte matrix may be a tile fabricated by hot-pressing alkali-chlorides and $LiAlO_2$ or tape-casting $LiAlO_2$ matrices. Tape casting can continuously manufacture matrices as thin as 0.03 to 0.07 centimeters and 45–55% porous with a mean pore size of 0.5 micrometers.

Low Temperature Molten Salts

Lewis acids are covalently bonded compounds capable of accepting a pair of electrons to complete a shell. Aluminum chloride ($AlCl_3$) is the preeminent example of a Lewis acid. This molecule, which occurs as the dimer ($Al_2Cl_6$), will readily combine with almost any free chloride to form a tetrahedral aluminum tetrachloride anion ($AlCl_4^-$). This covalently bonded ion acts as a large monovalent ion, with the negative charge dispersed over a large volume.

All of the alkali metal tetrachloroaluminates are known, and all have a key feature in common: the complex salt, with the negative charge dispersed over a large volume, has a far lower melting point than the corresponding simple chloride. These complex salts are well known and have been used as moderately high temperature (150–300° C.) solvents for a variety of purposes, including electrochemistry, spectroscopy, and crystal growth. A variety of unusual species have been found to be stable in acidic tetrachloroaluminate melts that cannot be synthesized in other ways.

Ambient temperature molten salts based on the same acid-base interactions were first reported in 1951. Interest in this field accelerated in the 1980's with the appearance of the widely studied substituted imidazoles. Table I shows some of the compounds capable of forming ambient temperature molten salts when combined with aluminum chloride.

All of these materials are ionic chlorides. With the exception of TMPAC, all have the positive charge delocalized to some degree through a π-conjugated system over a large portion of the volume of the bulky cation. In all cases, the combination of a large cation, with a low charge density and a large anion, with a low charge density, leads to a low melting solid. The combination is an ionic liquid that actually behaves in some respects more like a molecular liquid. Unlike high temperature molten salts, which tend to interact only through non-directional charge—charge interactions, these molten salts are hydrogen-bonded liquids with the cations forming a water-like network.

With Lewis acid systems, such as those formed by $AlCl_3$ and amine chlorides, which are aprotic, acidity and basicity are defined differently than in aqueous systems. A solution is acidic when the $AlCl_3$:amine chloride mole ratio is >1.0, basic when the ratio is <1.0, and neutral when the ratio is 1.0. Under basic conditions there are free chloride ions present. Under acidic conditions part of the aluminum chloride remains complexed to other aluminum chloride molecules, with heptachlorodialuminate, $Al_2Cl_7^-$, being a primary aluminum species. Under very acidic conditions, the trialuminate species, $Al_3Cl_{10}^-$ has been observed in (EMIM)$AlCl_4$ melts as well.

TABLE I

Compounds that Form Room Temperature Tetrachloroaluminate Salts

| Compound | Formula | Abbr. |
|---|---|---|
| 1-ethyl-3-methylimidazolium chloride | $C_6H_{11}N_2Cl$ | EMIM |
| Trimethyiphenylammonium chloride | $C_9H_{14}NCl$ | TMPAC |
| 1-methyl-3-ethyl-imidazolium chloride | $C_6H_{11}N_2Cl$ | MEIC |
| 1,3-dimethyl-imidazolium chloride | $C_5H_9N_2Cl$ | |
| 1-methyl-3-propyl-imidazolium chloride | $C_7H_{13}N_2Cl$ | |
| 1-methyl-3-butyl-imidazolium chloride | $C_8H_{15}N_2Cl$ | |
| 1,3-dibutyl-imidazolium chloride | $C_{11}H_{21}N_2Cl$ | |
| 1,2-dimethyl-3-propyl-imidazolium chloride | $C_8H_{15}N_2Cl$ | DMPrICl |
| N-butylpyridinium chloride | $C_9H_{14}NCl$ | BPC |
| N-propylpyridinium chloride | $C_8H_{12}NCl$ | |
| N-ethylpyridinium chloride | $C_7H_{10}NCl$ | |
| N-methylpyridinium chloride | $C_6H_8NCl$ | |

Impurities in the melt can alter its properties, or interfere with the electrochemistry. Minimizing these difficulties requires that all handling and use of these compounds be carried out under exceedingly inert, dry conditions. Impurities in melts, whether present in the starting materials or introduced later, can be removed using a number of purification processes developed for this purpose. Protons can be removed from melts by treatment with ethylaluminum dichloride, which reacts to generate ethane and $AlCl_3$. As the protons are removed, the melt becomes more acidic. Oxide and hydroxyl species can be removed from these systems by purging with phosgene. The oxo species react with the phosgene ($COCl_2$) to form $CO_2$ and free chloride ions, reducing the acidity of the melt.

Other work has led to the identification of other modifiers for specific properties of these melts. A variety of compounds, including anisole, 1,2-dichlorobenzene, diphenylether, chlorobenzene, fluorobenzene, and 1,4-difluorobenzene, have been demonstrated as viscosity modifiers for these systems.

Salts of most of the transition metals have already been demonstrated to dissolve in room temperature molten salts. Some of these dissolve under basic conditions, and others under acidic conditions. Of the eight transition elements not already reported as solution species, five are considered likely to form solutions.

The solution species formed by many of these elements have been identified. The solution species present when $NiCl_2$ and $CoCl_2$ are dissolved in the pure 1-ethyl-3-methylimidazolium (EMIM) chloride base have been identified as tetrahedral $MCl_4^=$ ions by single crystal x-ray diffraction studies of the $(EMIM)_2MCl_4$ salts. While both salts have melting points significantly above room temperature (100° C. for the Co salt and 92° C. for the Ni salt), both are soluble in (EMIM)$AlCl_4$, especially in the presence of excess acid ($AlCl_3$). The Co, Ni and Mn species present in these solutions have been identified as $[M(AlCl_4)_3]^-$ (M=Ni, Co, or Mn). Other solution species have been identified as well. Au goes into solution as the well-known tetrahedral $AuCl_4^-$ ion. Vanadium dissolves in (EMIM)$AlCl_4$ as the square pyramidal $VOCl_4^=$ ion.

EXAMPLE 1

Anhydrous lithium chloride and potassium chloride (Sigma Aldrich, St. Louis, Mo.) was vacuum dried for 48 hours at 140° C. After drying, the powders were removed from the vacuum oven and immediately placed into a vacuum dessicator before being transferred to a Vacuum Atmosphere Company dry box. An argon atmosphere was maintained at all times in the dry box, with oxygen and moisture concentrations below the detection limit of the sensors (1 ppm). A 59% LiCl/41% KCL/0.1% $Li_3N$ molar salt mixture was prepared by grinding the salts together with mortar and pestle, before transferring to a 100 ml high form alumina crucible (Fisher Scientific, Pittsburgh, Pa.).

All electrochemical measurements were performed versus a lithium/lithium ion reference electrode. The electrochemical cell was assembled in the glove box with the fuel cell type anode and cathode electrodes positioned with the active sides facing each other. The cathode was a sintered nickel gas diffusion electrode and the anode was a palladium metal membrane hydrogen separator. The cell was removed from the glove box and connected to the appropriate gas stream. Nitrogen was used for the cathode and hydrogen for the anode. Argon was used to provide an inert substitute for the reactive gases for background measurements. The current potential curves were recorded using an EG&G Parc Model 175 Universal programmer and an EG&G Model 371 Potentiostat-Galvanostat.

Ammonia was collected by bubbling gas from the exit line of the electrochemical ammonia synthesis cell into dilute (pH 3) hydrochloric acid solution. Ammonium ions ($NH_4^+$) are soluble in dilute HCl solution. As desired, the solution was sampled and ammonium concentration was determined using a Dionex DX-100 ion chromatograph with a Dionex 4270 integrator. The concentration of ammonia produced by the electrochemical cell could then be calculated.

The cell was assembled as previously described in a dry box under argon atmosphere. The nitrogen inlet tube on the cathode was connected to an ultra dry source of nitrogen and the anode attached to an ultra dry hydrogen source. The outlet of both the anode and cathode were sealed to the external atmosphere.

The cell was heated to 550° C. to melt the salts, and then the temperature was lowered to 500° C. for operation. Synthesis gases were flowed into the electrodes and the exit gas from the cell was collected in a dilute HCl solution (pH 3). The anode and cathode were attached to an EG&G Princeton Applied Research Model 371 Potentiostat/Galvanostst. The electrochemistry was controlled using an EG&G Parc Model 175 Universal Programmer. The cell was run under constant voltage, which was fixed at 0.382 V vs. $Li/Li^+$.

When the potential was applied a current of 16 Amps was measured. There was a strong smell of ammonia in the headspace above the collection solution. After 2 minutes of cell operation an aliquot of the solution was removed and analyzed using a Dionex DX 100 ion chromatograph. A 1.07-ppm standard ammonium solution was used to identify retention time for the ammonium ion. The standard had a retention time of 3.85 minutes with a peak area of 9271489. The 2-minute ammonia sample was run and it was found that the signal at 3.85 minutes saturated out. The sample was diluted by a factor of 250 and re-run. A signal was observed at 3.81 minutes with a peak area of 9992438. Calculating the ammonia concentration from the chromatograph showed the concentration of ammonium ion in the collection solution was 288 ppm, or which was equivalent to 29 mg of ammonia produced in the first 2 minutes of cell operation, which is $1.7\times10^{-3}$ Moles of ammonia.

The total charge consumed by the reaction Q=mnF

Where: m=number of moles of product formed
n=number of electrons involved in the reaction
and F=Faraday constant (96455 coulombs $mole^{-1}$)

Based on the results from the ammonia reactor the charged consumed in the reaction was 987 As. The total charge passed in the experiment was 1920 As. Therefore the current efficiency for the ammonia production (charge consumed in reaction of interest/total charge passed) was 51%.

It should be noted that the 51% current efficiency is based on the amount of ammonia collected in the solution. As mentioned previously there was a strong ammonia smell in the headspace above the collection solution indicating that not all of the ammonia being generated was being dissolved into the collection solution. Therefore 51% current efficiency is a minimum current efficiency based on the limited collection method.

EXAMPLE 2

An electrolyte salt mixture was prepared as described in Example 1 in a high form crucible. A fuel cell type cathode having a sintered nickel face was used along with an anode made from a titanium sheet attached to a nickel wire. Both electrodes were sealed into the reactor cap, placed into the powdered electrolyte salt. The reactor cap was then secured in position and sealed and an inert atmosphere was maintained. The reactor was then placed into a heater unit. Both electrodes were attached to a Tenmax Laboratory DC Power Supply Model No. 72-420. The nitrogen gas used to generate the nitride ion was dried using molecular sieves before it was flowed into the cell. Once a gas flow was established, the system was back pressured using a valve on the outlet line to prevent the molten salt from filling the internal cavity. Once the eutectic salt mixture reached the melting temperature a constant current of 0.1 Amp was applied for 45 minutes. As the reaction proceeded, the cell voltage increased with time until reaching a stable value of 1.0 V. When the reaction was completed the reactor cap was removed and the electrodes recovered while the salt was still in the molten state. Visual examination of the titanium electrode showed that the surface had turned a golden yellow color that is characteristic of titanium nitride.

The increase in the cell voltage with time is believed to be related to changing resistance within the cell and is commonly observed with film formation. The fact that the electrochemical reaction was current limited shows that the formation of the nitride ion is controlled by the mass transfer of the nitrogen gas through the surface of the porous nickel. The formation of titanium nitride on the surface of the titanium anode verifies the cell's ability to generate the nitride ion.

The term "comprising" means that the recited elements or steps may be only part of the device and does not exclude additional unrecited elements or steps.

While the foregoing is directed to the preferred embodiment of the present invention, other and further embodiments of the invention may be devised without departing from the basic scope thereof, and the scope thereof is determined by the claims that follow.

What is claimed is:

1. An apparatus comprising:

a porous anode substrate in fluid communication with a source of hydrogen gas;

a porous cathode substrate in fluid communication with a source of nitrogen gas; and a liquid electrolyte disposed within a matrix, wherein the matrix is disposed between the porous anode substrate and the porous cathode substrate, and wherein the liquid electrolyte is not an aqueous solution.

2. The apparatus of claim 1, further comprising:

a catalyst disposed on the anode substrate facing the electrolyte matrix.

3. The apparatus of claim 1, further comprising:

a catalyst disposed on the cathode substrate facing the electrolyte matrix.

4. The apparatus of claim 1, wherein the porous anode substrate has a porosity greater than 40 percent.

5. The apparatus of claim 1, wherein the porous anode substrate has a porosity greater than 90 percent.

6. The apparatus of claim 1, further comprising:

a metal membrane having a thickness of between 1 and 200 microns disposed on the porous anode substrate facing the electrolyte matrix.

7. The apparatus of claim 6, wherein the metal membrane is made from a metal selected from palladium, a palladium alloy, iron, tantalum, lanthanide metals, or combinations thereof.

8. The apparatus of claim 6, further comprising a matrix supporting the metal membrane, wherein the matrix is formed from a material selected from nickel or nickel-containing alloys.

9. The apparatus of claim 6, further comprising a matrix supporting the metal membrane, wherein the matrix is formed from a material selected from transition metals or transition metal-containing alloys.

10. The apparatus of claim 6, further comprising a matrix supporting the metal membrane, wherein the matrix is formed from an electrically conducting inorganic ceramic material.

11. The apparatus of claim 6, wherein a catalyst is disposed on a surface of the metal membrane facing the electrolyte.

12. The apparatus of claim 11, wherein the catalyst comprises a metal selected from iron, ruthenium or combinations thereof.

13. The apparatus of claim 1, further comprising:

a metal membrane having a thickness of between 1 and 200 microns disposed on both sides of the porous anode substrate, wherein the porous anode substrate is a non-noble metal and the metal membrane is palladium or a palladium-containing alloy.

14. The apparatus of claim 13, wherein the non-noble metal is selected from iron, tantalum, or lanthanide metals.

15. The apparatus of claim 1, wherein the porous cathode substrate is made from nickel, a nickel-containing compound, or a nickel alloy.

16. The apparatus of claim 1, wherein the porous cathode substrate is made from metal, metal alloy, ceramic or a combination thereof.

17. The apparatus of claim 1, wherein the porous cathode substrate has a pore size of about 0.2 microns.

18. The apparatus of claim 1, wherein the electrolyte supports migration of negatively charged nitrogen-containing species between the cathode substrate and the anode.

19. The apparatus of claim 1, wherein the electrolyte comprises a molten salt.

20. The apparatus of claim 19, wherein the molten salt comprises one or more metal chlorides.

21. The apparatus of claim 19, wherein the molten salt comprises one or more metal salts selected from chlorides, iodides, bromides, sulfides, phosphates, carbonates, or mixtures thereof.

22. The apparatus of claim 19, wherein the molten salt comprises lithium chloride and potassium chloride.

23. The apparatus of claim 22, wherein the molten salt further comprises a metal nitride salt.

24. The apparatus of claim 22, wherein the molten salt electrolyte has a greater molar concentration of lithium chloride than potassium chloride.

25. The apparatus of claim 22, wherein the molten salt electrolyte further comprises rubidium chloride, cesium chloride, ruthenium chloride, iron chloride, or a mixture thereof.

26. The apparatus of claim 1, wherein the electrolyte comprises a salt dissolved in an organic solvent.

27. The apparatus of claim 1, wherein the electrolyte comprises low temperature molten salts.

28. An apparatus comprising:

a plurality of electrolytic cells and a bipolar plate separating each of the plurality of electrolytic cells, wherein each of the plurality of electrolytic cells comprises:

a porous anode substrate in fluid communication with a source of hydrogen gas;

a porous cathode substrate in fluid communication with a source of nitrogen gas;

a liquid electrolyte disposed within a matrix placed between the porous anode substrate and the porous cathode substrate, wherein the liquid electrolyte is not an aqueous solution;

an anodic fluid flowfield in fluid communication with the porous anode substrate opposite the matrix; and a cathodic fluid flowfield in fluid communication with the porous cathode substrate opposite the matrix.

29. The apparatus of claim 28, wherein the anodic fluid flowfield has a first face that is in electronic communication with the porous anode substrate and a second face in electronic communication with a first bipolar plate, and wherein the cathodic fluid flowfield has a first face that is in electronic communication with the porous cathode substrate and a second face in electronic communication with a second bipolar plate.

30. The apparatus of claim 28, further comprising:

a hydrogen gas manifold for providing fluid communication between the source of hydrogen gas and each of the anodic fluid flowfields; and a nitrogen gas manifold for providing fluid communication between the source of nitrogen gas and each of the cathodic fluid flowfields.

31. The apparatus of claim 30, wherein the hydrogen gas manifold and the nitrogen gas manifold are each selected from an internal manifold or an external manifold.

32. The apparatus of claim 28, wherein the porous anode substrate and the porous cathode substrate are each selected from metal foams, metal grids, sintered metal particles, sintered metal fibers, or combinations thereof.

33. The apparatus of claim 28, wherein the anodic fluid flowfield is metallurgically bonded to the bipolar plate.

34. The apparatus of claim 33, wherein the metallurgical bonds are formed by a process selected from welding, brazing, soldering, sintering, fusion bonding, vacuum bonding, or combinations thereof.

35. The apparatus of claim 28, wherein the cathodic fluid flowfield is metallurgically bonded to the bipolar plate.

36. The apparatus of claim 28, wherein the anodic fluid flowfield is metallurgically bonded to the porous anode substrate.

37. The apparatus of claim 28, herein the cathodic fluid flowfield is metallurgically bonded to the porous cathode substrate.

38. The apparatus of claim 28, wherein the porous cathode substrate is selected from metal carbides, metal borides or metal nitrides.

39. The apparatus of claim 28, wherein the electrolyte comprises a molten salt.

40. The apparatus of claim 39, wherein the molten salt is charged with a nitride salt.

41. The apparatus of claim 39, wherein the molten salt is charged with a nitride compound, an azide compound, or a combination thereof.

42. The apparatus of claim 39, wherein the molten salt comprises lithium chloride and potassium chloride.

43. The apparatus of claim 39, wherein the molten salt further comprises rubidium chloride, cesium chloride, ruthenium chloride, iron chloride or a mixture thereof.

44. The apparatus of claim 39, wherein the molten salt comprises one or more metal chlorides.

45. The apparatus of claim 39, wherein the molten salt comprises one or more metal salts selected from chlorides, iodides, bromides, sulfides, phosphates, carbonates or mixtures thereof.

46. The apparatus of claim 28, wherein the electrolyte comprises a low temperature molten salt.

47. The apparatus of claim 28, wherein the electrolyte comprises a salt dissolved in an organic solvent.

* * * * *

UNITED STATES PATENT AND TRADEMARK OFFICE

CERTIFICATE OF CORRECTION

PATENT NO. : 6,881,308 B2
DATED : April 19, 2005
INVENTOR(S) : Adrian J. Denvir et al.

It is certified that error appears in the above-identified patent and that said Letters Patent is hereby corrected as shown below:

Column 1,
Line 7, replace "grants nos. 00-33610-8929 and 2202-3310-12426" with
-- grants nos. 00-33610-8928 and 2202-33610-12426 --.

Signed and Sealed this

Seventh Day of June, 2005

JON W. DUDAS
*Director of the United States Patent and Trademark Office*